US006389611B2

(12) United States Patent
Fujita

(10) Patent No.: US 6,389,611 B2
(45) Date of Patent: May 21, 2002

(54) HINGE DEVICE FOR SUPPORTING SEAT AND SEAT LID OF TOILET BOWL OPENABLY AND CLOSABLY

(75) Inventor: Oriya Fujita, Kanagawa (JP)

(73) Assignee: Katoh Electrical Machinery Company, Ltd., Kanagawa (JP)

( * ) Notice: Subject to any disclaimer, the term of this patent is extended or adjusted under 35 U.S.C. 154(b) by 0 days.

(21) Appl. No.: 09/776,398

(22) Filed: Feb. 2, 2001

Related U.S. Application Data

(62) Division of application No. 09/302,030, filed on Apr. 29, 1999, now Pat. No. 6,275,999.

(30) Foreign Application Priority Data

May 1, 1998 (JP) ..... 10-122571
Jun. 16, 1998 (JP) ..... 10-169044

(51) Int. Cl.[7] ..... A47K 13/12

(52) U.S. Cl. ..... 4/236; 4/248; 16/298; 16/303

(58) Field of Search ..... 4/236, 240, 246.1, 4/248; 16/298, 299, 303

(56) References Cited

U.S. PATENT DOCUMENTS 3,975,794 A * 8/1976 Kaiser et al. ..... 16/303
6,052,869 A * 4/2000 Suzuki ..... 4/248 X

* cited by examiner

*Primary Examiner*—Robert M. Fetsuga
(74) *Attorney, Agent, or Firm*—Notaro & Michalos P.C.

(57) ABSTRACT

A hinge device for use to support a seat and seat lid of a toilet bowl openably and closably is provided which can also be implemented even without any rubber ring and provide a delicately controlled feeling with the sea and seat lid when being opened or closed. The hinge device comprises a cylindrical hinge case to be fixed to the body of a toilet bowl and having a partition wall formed therein; a rotating shaft provided rotatably inside the hinge case to support a seat and seat lid of the toilet bowl and consisting of a large-diameter portion which is born in the inner wall of the hinge case and a small-diameter portion which is born in a bearing hole formed in the partition wall of the hinge case; a stationary cam provided inside the hinge case, fixed to the partition wall of the hinge case and having the small-diameter portion of the rotating shaft penetrated through the central portion thereof; a rotatable sliding cam provided inside the hinge case opposite the stationary cam to be slidable axially and rotatable along with the small-diameter portion of the rotating shaft penetrated through the central portion thereof; an elastic means wound on the outer surface of the rotating shaft and between the rotatable sliding cam and the large-diameter portion of the rotating shaft; and means for adjusting the elasticity of the elastic means.

5 Claims, 12 Drawing Sheets

HINGE DEVICE FOR SUPPORTING SEAT AND SEAT LID OF TOILET BOWL OPENABLY AND CLOSABLY

CROSS-REFERENCE TO RELATED APPLICATION

This is a divisional of application Ser. No. 09/302,030 filed Apr. 29, 1999 now Pat. No. 6,275,999.

BACKGROUND OF THE INVENTION

1. Field of the Invention

The present invention relates to a hinge, and more particularly to a hinge device suitable for use to support a seat and seat lid of a toilet bowl openably and closably.

2. Description of the Prior Art

Various types of hinge devices have so far been proposed for supporting a toilet bowl seat and seat lid openably and closably. Typical ones of such hinge devices include a combination of a rotating shaft to support the seat and seat lid of the toilet bowl and a cam mechanism provided with a compression spring which acts on the shaft, a combination of a rotating shaft and a torsion spring which acts in a direction of canceling a torque of the rotating shaft being rotated in a predetermined direction, a combination of a rotating shaft and a hydraulic damper which acts on the rotating shaft, or a similar combination.

The conventional hinge device of the type in which only the cam mechanism is allowed to act on the rotating shaft is advantageous in that a matching can easily be attained between a torque generated when the seat and/or lid are operated and a rotation moment of the seat and lid. For a large torque, however, the hinge device should have a large structure.

The conventional hinge device in which only the torsion spring acts on the rotating shaft has an advantageous in that even a small structure of the hinge device can create a large torque. Since the torque increases and decreases linearly as the seat and/or seat lid are operated, however, no easy matching is attainable between the torque of the seat and seat lid and a sine curve depicted by the rotation moment of the seat and lid being operated, so that it is difficult to elaborately fit the torque of the seat and seat lid to a curve delineated by the rotation moment of them when being operated and also to provide an appropriately accented operation of the seat and lid being operated.

Further, the conventional hinge device in which only the hydraulic damper is used to act on the rotating shaft is not advantageous in the difficulty of elaborately fitting the torque of the seat and seat lid to a curve depicted by the rotation moment of them and also of providing an appropriately accented motion of the seat and lid being opened or closed, for example, stopping and holding the seat at an intermediate angular position, and braking the seat having been opened to a predetermined angular position.

To control the rotation moment of the openable/closable body such as a seat and seat lid of a toilet bowl in order to softly close the openable/closable body, the Inventor of the present invention proposed a hinge device for use to support the seat and seat lid of the toilet bowl openably and closably, comprising a hinge case, a rotating shaft rotatably provided inside the hinge case, a stationary cam having the rotating shaft penetrated through the center thereof and fixed inside the hinge shaft, a rotatable sliding cam having the rotating shaft penetrated through the central portion thereof to be slidable axially and rotatable with the rotating shaft, and an elastic means for urging the rotatable sliding cam towards the stationary cam, the hinge device comprising a damping means consisting of a rubber ring fitted on the rotating shaft and between the rotating shaft and hinge case and a viscous oil applied between the rubber ring and hinge case, the damping means being allowed to act on the rotating shaft.

In this hinge device, a pressure under which the rubber ring is urged to the inner wall of the hinge case can be adjusted to control the torque of the rotating shaft. However, this hinge device is disadvantageous in that it is only applicable to a hinge device in which such a rubber ring is used.

SUMMARY OF THE INVENTION

Accordingly, the present invention has an object to overcome the above-mentioned drawbacks of the prior art by providing a hinge device for use to support a seat and seat lid of a toilet bowl, implementable even without any rubber ring used, and which can provide a delicately controlled feeling with the motion of the seat and seat lid supported by the hinge device.

The above object can be attained by providing a hinge device for use to support a seat and seat lid of a toilet bowl, comprising a hinge case, a rotating shaft provided rotatably inside the hinge case, a stationary cam having the rotating shaft penetrated through the central portion thereof and fixed to a partition wall provided inside the hinge case, a rotatable sliding cam having the rotating shaft penetrated through the central portion thereof slidably axially and rotatably along with the rotating shaft, an elastic means for urging the rotatable sliding cam towards the stationary cam, and:

means for adjusting the elasticity of the elastic means.

According to the present invention, the adjusting means may be composed of a plurality of projections formed on an end face of the stationary cam opposite to the rotatable sliding cam, extending through and out of the partition wall of the hinge case in a direction away from the rotatable sliding cam and axially slidable in the partition wall, and an adjusting screw abutting the projections and screwed to the hinge case.

According to the present invention, the adjusting means may be formed from a cap abutting one end of the elastic means and screwed in the hinge case.

The above object can be attained also by providing a hinge device for use to support a seat and seat lid of a toilet bowl, comprising:

a hinge case;

a rotating shaft provided rotatably inside the hinge case;

a rubber ring fitted on the rotating shaft and in forced contact wit the inner wall of the hinge case;

a damping means formed from a viscous oil applied to the outer surface of the rubber ring;

a rotatable cam provided on the rotating shaft;

a sliding cam provided slidably inside the hinge case and having formed opposite the rotating shaft in a central portion thereof a hole through which the rotating shaft is penetrated;

a cap provided at a side of the sliding cam opposite to the rotatable cam and screwed to the hinge case to be movable axially; and an elastic means provided inside the hinge case between the cap and sliding cam.

Also, the above object can be attained by providing a hinge device for use to support a seat and seat lid of a toilet bowl, comprising:.

a hinge case;

a rotating shaft provided rotatably inside the hinge case;

a stationary sliding cam engaged axially slidably inside the hinge case and having formed in the central portion thereof a hole through which the rotating shaft is penetrated;

a rotatable sliding cam provided inside the hinge case opposite the stationary sliding cam and having the rotating shaft engaged in a hole formed in the center thereof rotatably along with the stationary sliding cam;

an elastic means provided wound on the rotating shaft and between the hinge case and stationary sliding cam;

a damping means provided slidably inside the hinge case and made of a rotation damper having a pivot coupled to a side of the rotatable sliding cam opposite to the stationary sliding cam; and a cap screwed to the hinge case to slide the rotation damper axially of the hinge case.

These objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

The present invention will be described hereinafter concerning an embodiment of the hinge device adapted for use with an openable/closable body such as a seat and seat lid of a toilet bowl. It should be noted, however, that the present invention is not limited to such an embodiment but it is applicable for use with various openable and closable bodies.

Figure 1:
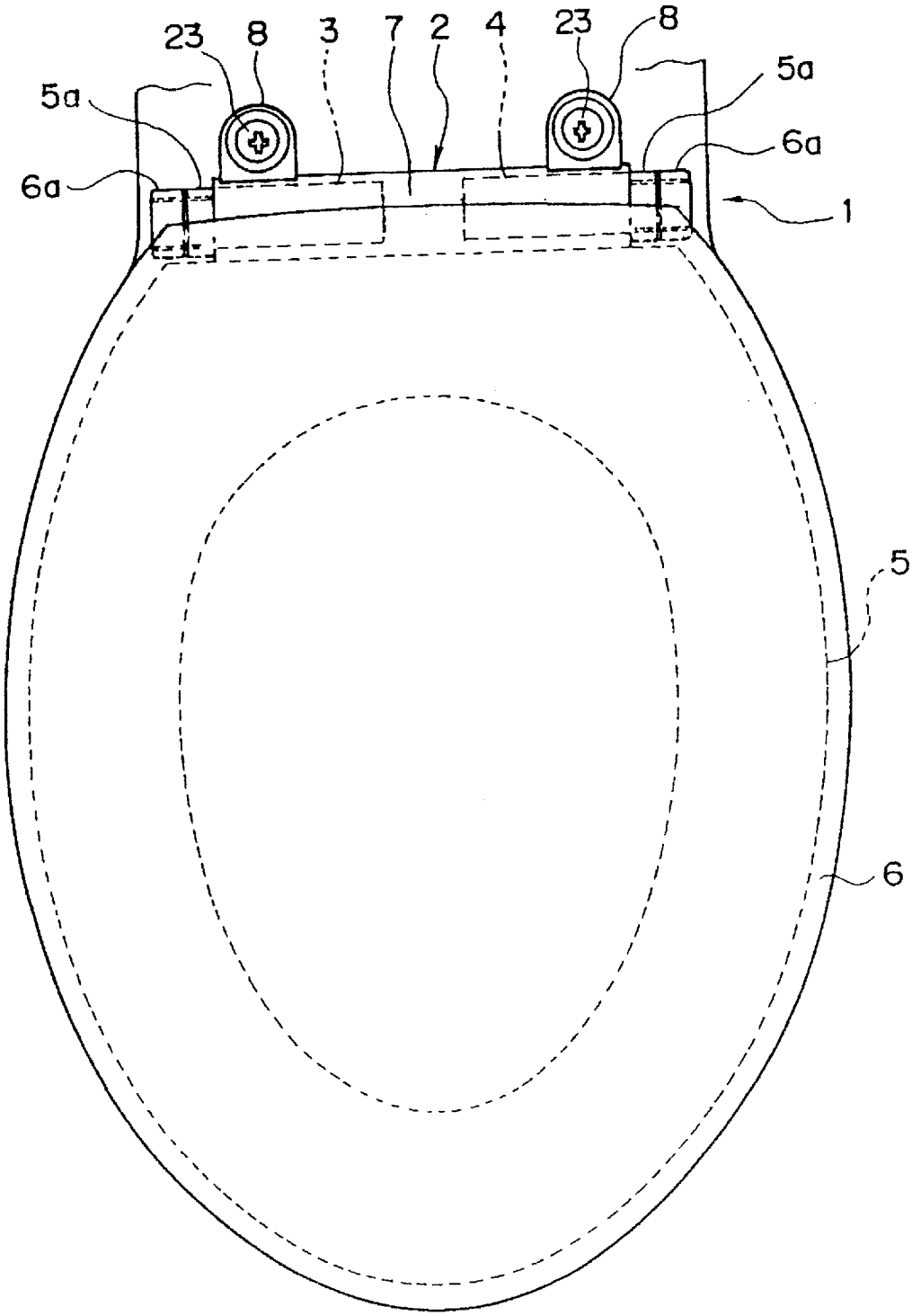
FIG. 1 is a plan view of a toilet bowl provided with the hinge device according to the present invention.
Figure 2:
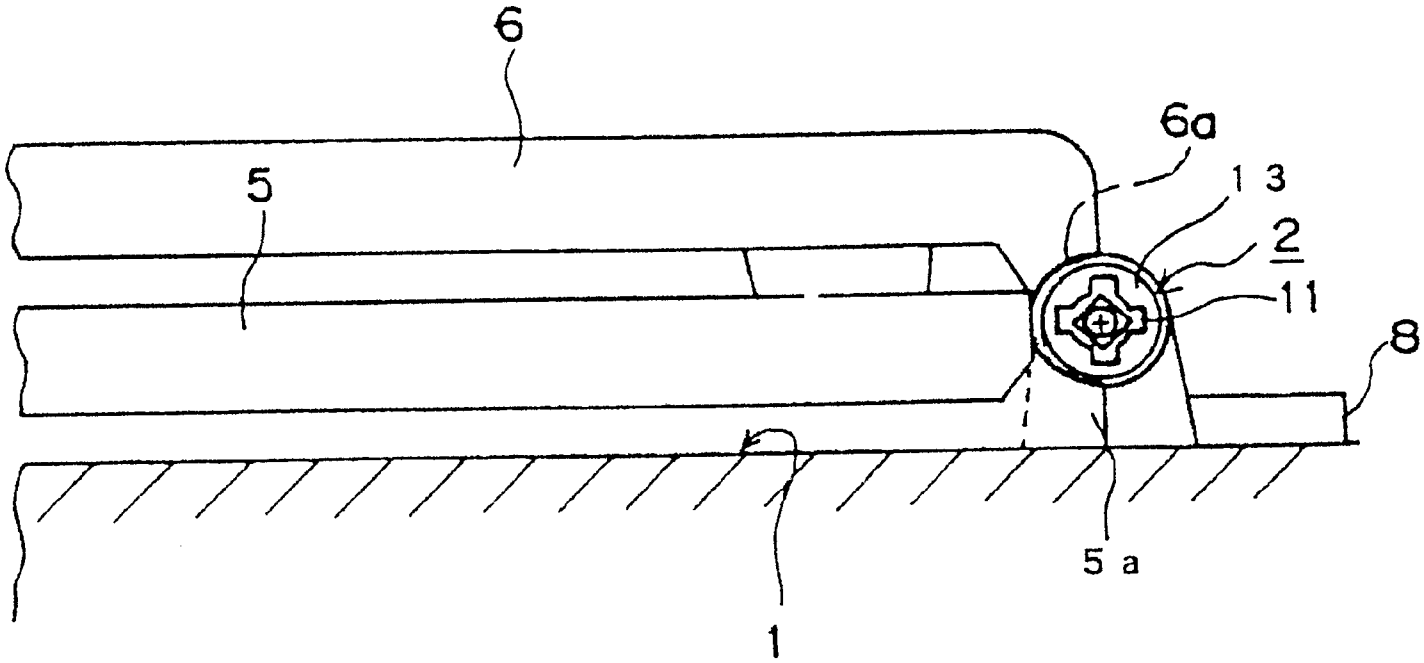
FIG. 2 is a side elevation of the hinge device in FIG. 1, with some parts being omitted.
Figure 3:
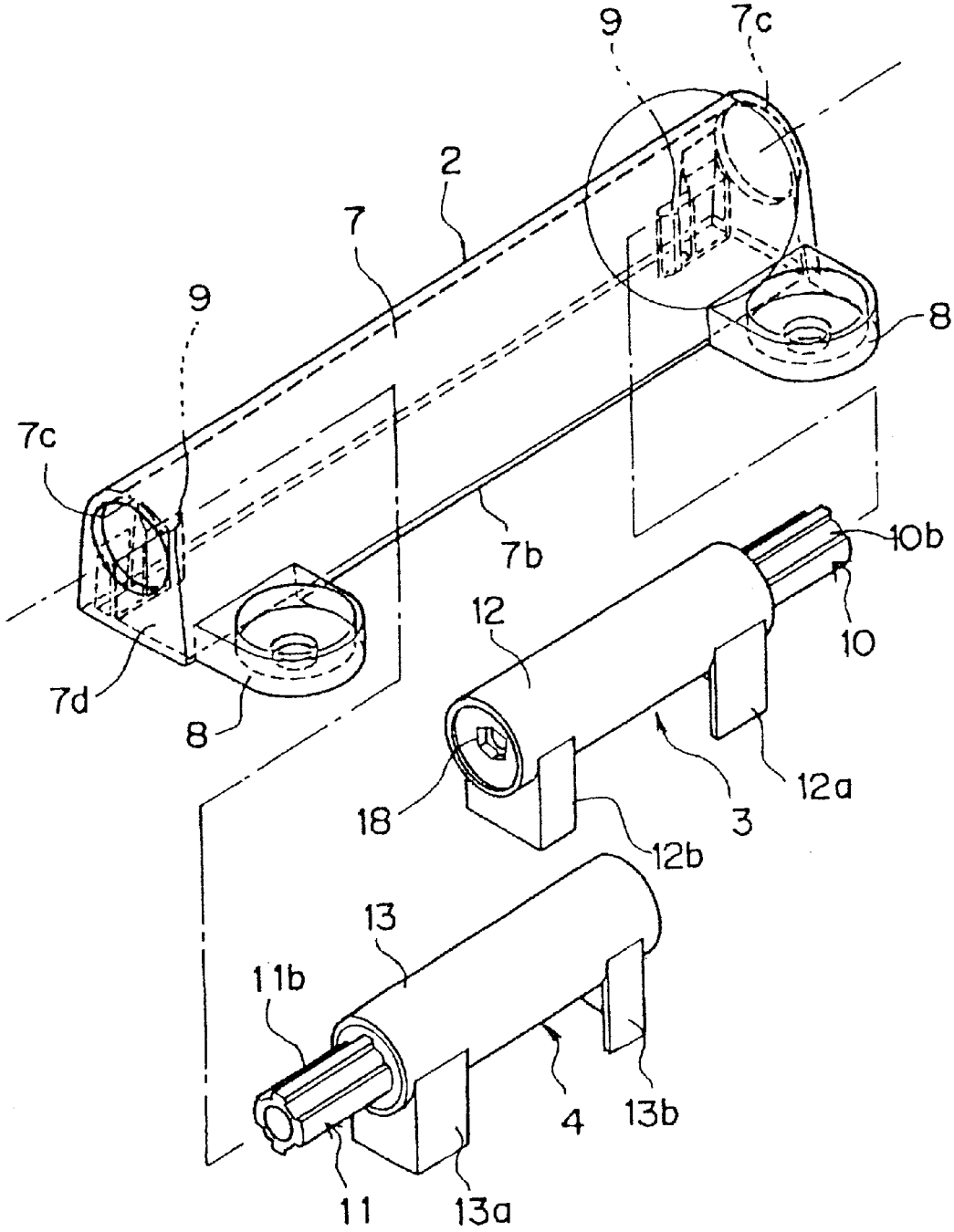
FIG. 3 is an exploded perspective view of the hinge device of the present invention, showing the installation of the hinge device to a seat and seat lid of a toilet bowl.

A first embodiment of the device according to the present invention will be described herebelow with reference to FIGS. 1 to 13. As shown in FIGS. 1 to 3, a reference numeral 1 indicates the body of a toilet bowl, 2 a holder, and 3 and 4 hinge devices for a seat 5 and a seat lid 6, respectively, removably installed in the holder 2.

The holder 2 consists of a case body 7 molded from a synthetic resin to have a generally barrel-roof shape, open at the bottom thereof (as indicated with a reference 7*b*) and having an insertion hole 7*c* formed in either end thereof, a pair of fixtures 8 formed integrally and projected from one side of the case body 7, and engagement pieces 9 provided on one inner wall of the case body 7 in the proximity of the holes 7*c* at the opposite ends of the case body 7.

A pair of hinge devices 3 and 4 is inserted into the case body 7 of the holder 2 from the open bottom 7*b*. The hinge devices 3 and 4 comprise hinge cases 12 and 13 and rotating shafts 10 and 11 projected out of the hinge cases 12 and 13, respectively, from the holes 7*c* of the case bodies 7. The hinge case 12 of the hinge device 3 has legs 12*a* and 12*b* projecting downward and the hinge case 13 of the hinge device 4 has legs 13*a* and 13*b* projecting downward. The legs 12*a* and 13*a* are engaged in the engagement pieces 9, respectively, to secure the hinge cases 12 and 13. The inside diameter of the holes 7*c* formed in the ends of the holder 2 is equal to or smaller than the outside diameter of the hinge cases 12 and 13 of the hinge devices 3 and 4, respectively, placed inside the holder 2. The case body 7 has a lateral plate 7*d* on either end thereof to prevent the hinge devices 3 and 4 once put in the case body 7 from coming axially from the insertion holes 7*c*.

Figure 5:
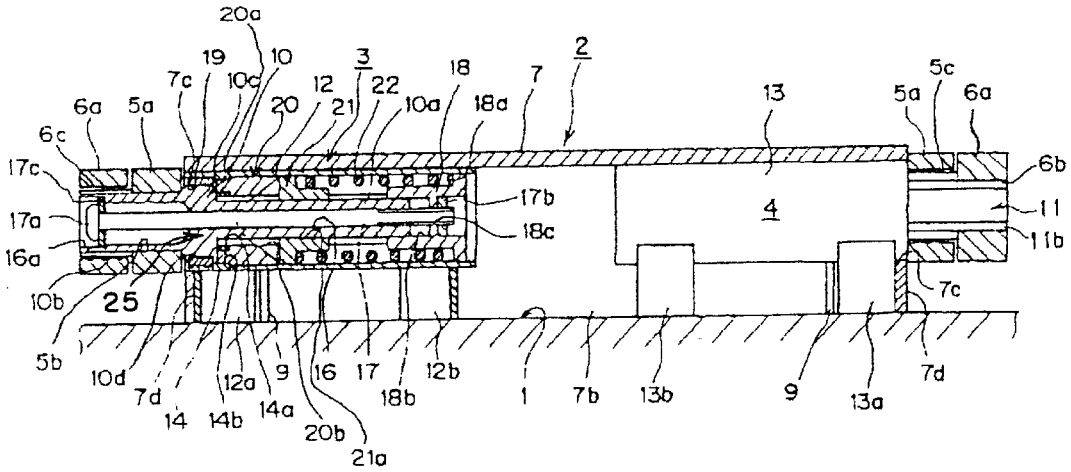
FIG. 5 is a partially cross-sectional front view of the hinge device of the present invention, installed to the seat and seat lid of a toilet bowl.

Of the pair of hinge devices 3 and 4 set inside the case body 7 of the holder 2, the left one in FIG. 5 is for use with a seat 5 and the right one is for use with a seat lid 6. The hinge devices 3 and 4 are of a same basic internal structure except that for a main reason that the seat 5 differs in weight from the seat lid 6, the elasticity of an elastic means formed from a compression spring and shape of a cam portion of a cam member are different between the hinge devices 3 and 4. Therefore, this embodiment will be described below concerning the hinge device 3 for the seat.

Figure 4:
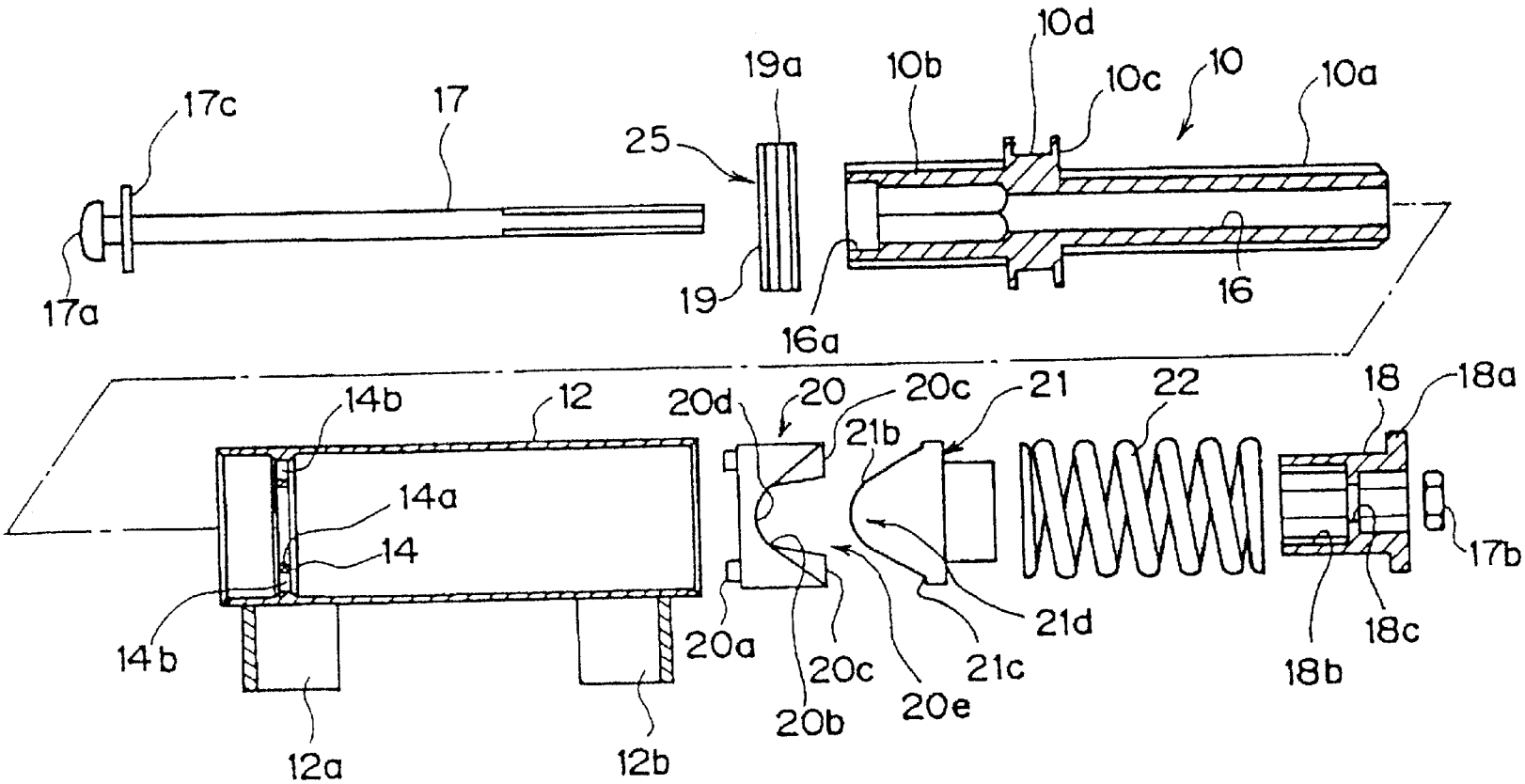
FIG. 4 is a partially axial-sectional exploded front view of the hinge device of the present invention, installed to the seat and seat lid of a toilet bowl.

As shown in FIG. 4, the legs 12*a* and 12*b* in pair are provided with a predetermined space between them on the bottom of the cylindrical hinge case 12,. One of the legs 12*a* is engaged in the engagement piece 9 provided inside the case body 7 of the holder 2 when the hinge device 3 is put into the case body 7 to block the hinge device 3 from moving axially inside the case body 7. The bottom end faces of these legs 12*a* and 12*b* will be flush with the bottom plane of the case body 7 when the hinge device 3 is set in the case body 7.

As also seen from FIG. 4, there is provided inside the hinge case 12 of the hinge device 3 a partition wall 14 formed near the left end of the hinge case 12. The partition wall 14 has formed therein a bearing hole 14*a* through which the rotating shaft 10 is axially penetrated inside the hinge case 12 to be rotatable. The rotating shaft 10 has formed axially in the central portion thereof a stepped through-hole 16 through which an adjusting screw 17 is penetrated. The through-hole 16 has a large-diameter portion 16*a* in which a head 17*a* of the adjusting screw 17 is engaged. The free end of the adjusting screw 17 inside the case body 17 is projected out of the end of the rotating shaft 10. There is screwed on the projected portion of the adjusting screw 17 a nut 17*b* on which a spring holder 18 rests. The reference 17*c* indicates a washer. The spring holder 18 has formed at one end thereof a flange 18*a* which is in contact with the inner wall of the hinge case 12, and it further has a non-circular hole 18*b* formed axially in the central portion thereof at the other end thereof. The rotating shaft 10 has a non-round small-diameter portion 10*a* is engaged in the non-circular hole 18*b*. Thus, the spring holder 18 is rotatable with the rotating shaft 10 and axially slidable inside the hinge case 12. The reference 18*c* indicates a small hole through which the adjusting screw 17 is penetrated. The rotating shaft 10 has a non-round fixing shaft portion 10*b* on which a large-diameter portion 10*c* of which the outside diameter is nearly same as the inside diameter of the hinge case 12 and on which there is formed a circumferential groove 10*d* on which a rubber ring 19 of a rotation control means 25 is fitted. The rubber ring 19 has a plurality of circumferential grooves 19*a*, and a viscous oil (not shown) is charged between the outer surface of the rubber ring 19 and the inner wall of the hinge case 12. Note that the rubber ring 19 is not limited in material to a rubber but it may be a well-known one made of any other material such as a synthetic resin.

As best shown in FIGS. 4 and 5, the hinge case 12 has a plurality of projections 20*a* formed therein and at one end thereof, and the partition wall 14 has formed therein a plurality of engagement holes 14*b*. The plurality of projections 20*a* is inserted in the plurality of engagement holes 14*b*. The hinge device 3 further comprises a stationary cam 20 and a rotatable sliding cam 21. The stationary cam 20 has formed axially in the central portion thereof a circular hole 20*b* through which the non-round small-diameter portion of the rotating shaft 10 is rotatably penetrated. The stationary cam 20 has a non-circular hole 21*a* formed axially in the central portion thereof, and a cam portion 20*e* consists of crests 20*c* and troughs 20*d*. With the non-round small-diameter portion 10*a* of the rotating shaft 10 engaged in the non-circular hole 21*a*, the rotatable sliding cam 21 is disposed opposite the stationary cam 20 to be rotatable with the rotating shaft 10 and slidable axially of the rotating shaft 10. The rotatable sliding cam 21 has a cam portion 21*d* consisting of crests 21*b* and toughs 21*c*. The cam portion 21*d* of the rotatable sliding cam 21 is opposite to the cam portion 20*e* of the stationary cam 20. An elastic means 22 formed from a compression spring, for example, is wound over the non-round small-diameter portion 10*a* of the rotating shaft 10 and the spring holder 18 and between the rotatable sliding cam 21 and flange 18*a* of the spring holder 18. The elastic means 22 urges the rotatable sliding cam 21 to slide towards the stationary cam 20.

Figure 6:
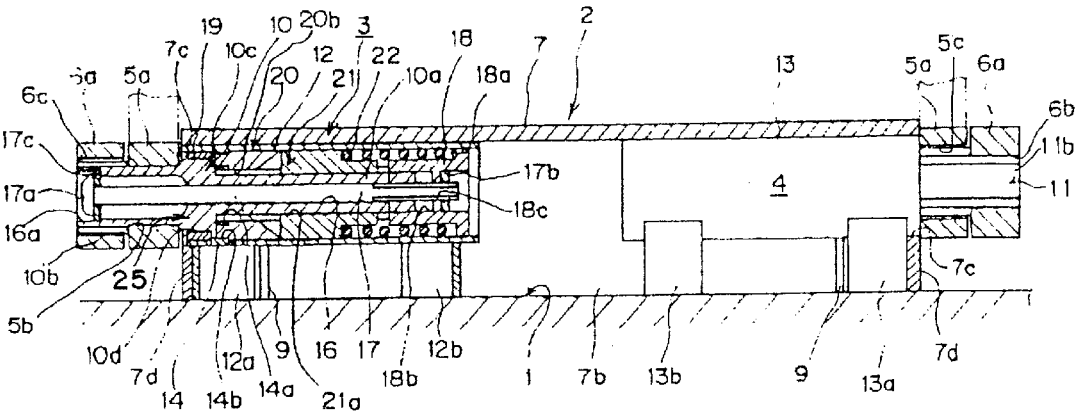
FIG. 6 is a partially cross-sectional front view of the hinge device of the present invention, installed to the seat and seat lid of a toilet bowl.
Figure 7:
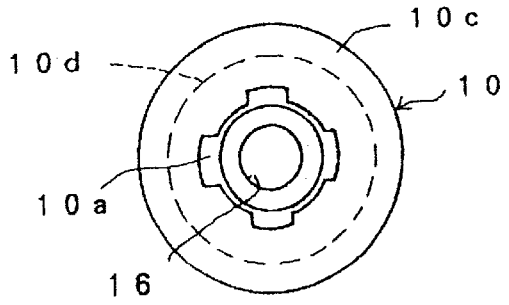
FIG. 7 is a right side elevation of the rotating shaft of the hinge-device shown in FIGS. 1 to 6.
Figure 8:
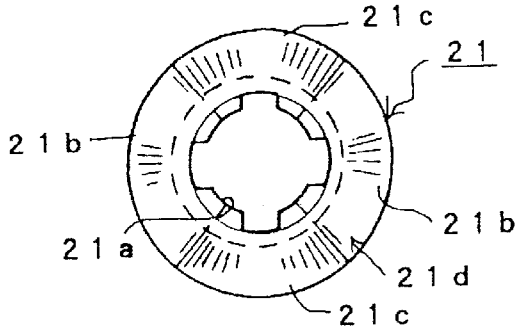
FIG. 8 is a left side elevation of the rotatable sliding cam included in the present invention.
Figure 9:
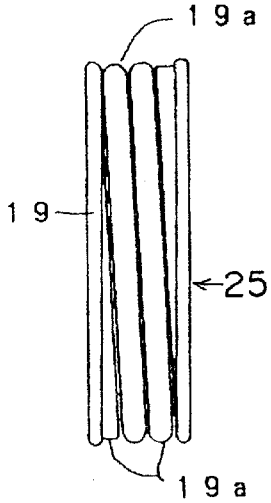
FIG. 9 is a front view, enlarged in scale, of the damper ring included in the present invention.
Figure 10:
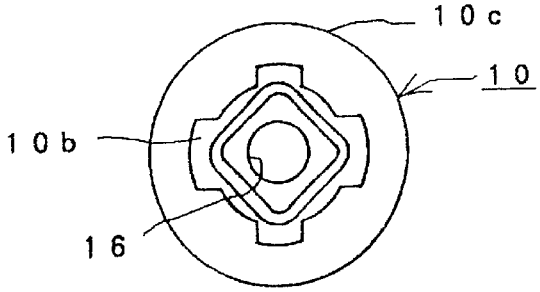
FIG. 10 is a left side elevation of the rotating shaft included in the hinge device shown in FIGS. 1 to 6.
Figure 11:
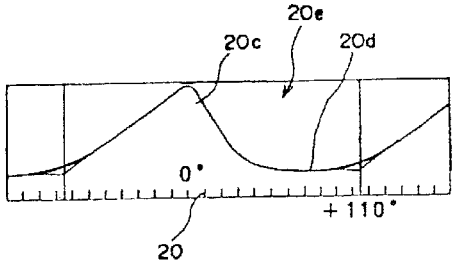
FIG. 11 is a development of the cam portion of the fixing cam included in the present invention.
Figure 12:
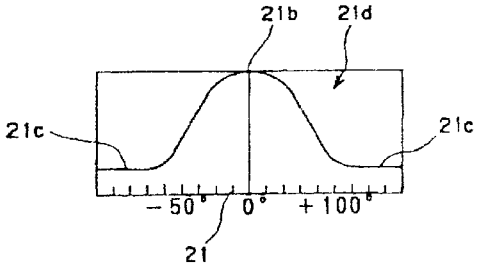
FIG. 12 is a development of the cam portion of the rotatable sliding cam member included in the present invention.
Figure 13:
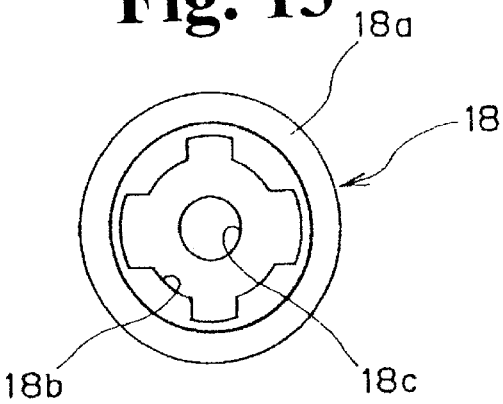
FIG. 13 is a left elevation of the spring holder included in the present invention.

As shown in FIGS. 5 and 6, the fixture 5*a* for the seat 5 has formed therein a non-circular fixing hole 5*b* in which the non-round fixing shaft portion 10*b* of the rotating shaft 10 of the hinge device 3 for the seat is engaged, so that when the seat 5 is operated, it is rotated along with the rotating shaft 10. The fixture 6*a* for the seat lid 6 has also formed therein a circular fixing hole 6*c* in which the fixing shaft portion 10*b* of the rotating shaft 10 is inserted. When the seat lid 6 is operated, it is rotated about the rotating shaft 10, not rotated with the latter.

On the other hand, the rotating shaft 11 included in the right hinge device 4 for the seat lid 6 has a non-round fixing shaft portion 11*b*. The fixture 6*a* for the seat lid 6 has a non-circular fixing hole 6*b* formed therein. The non-round fixing shaft portion 11*b* of the rotating shaft 11 is inserted in the non-circuit fixing hole 6*b* while the fixture 5*a* for the seat 5 is born in the circular fixing hole 5*c*. Thus, as the seat lid 6 is operated, the rotating shaft 11 of the right hinge device 4 is rotated correspondingly, but not when the seat 6 is operated.

In this embodiment in which the fixtures 5*a* and 6*a* are formed integrally with the seat 5 and sea lid 6, respectively, with the non-circular fixing holes 5*b* and 6*b* and circular fixing holes 5*c* and 6*c* formed in the fixtures 5*a* and 6*a*, respectively, aligned beforehand with the insertion holes 7*c* formed at the opposite ends of the case body 7 of the holder 2, any one of the hinge devices 3 and 4 is first inserted into the case body 7 from the opening 7*b*. Concerning the hinge case 3, it is inserted into the case body 7 of the holder 2 from the bottom opening 7*b* and displaced axially until the rotating shaft 10 is projected out of the insertion hole 7*c* at the end of the case body 7. While the leg 12*a* is being engaged into the engagement piece 9, the rotating shaft 10 is inserted into one non-circular fixing hole 5*b* and circular fixing hole 6*c* in the fixtures 5*a* and 6*a*, respectively, of the seat 5 and seat lid 6. Next, concerning the hinge device 4, it is inserted into the case body 7 from the bottom opening and displaced axially until the rotating shaft 11 is projected out of the insertion hole 7*c* in the other end of the case body 7. While the leg 13*a* is being engaged into the engagement piece 9, the rotating shaft 11 is inserted into the other circular fixing hole 5*c* and non-circular fixing hole 6*b* in the fixtures 5*a* and 6*a*, respectively, of the seat 5 and seat lid 6.

The holder 2 is positioned in place on the toilet bowl body 1, and the fixtures 8 are secured to the toilet bowl body 1 with fixing bolts 23.

After that, when the seat 5 is operated, the rotating shaft 10 is rotated correspondingly. When the seat 5 is in the closed position, the crests 20*c* of the cam portion 20*e* of the stationary cam 20 are pressed to the crests 21*b* of the cam portion 21*d* of the rotatable sliding cam 21 under the elasticity of the elastic means 22. When the seat 5 is opened, the crests 21*b* of the rotatable sliding cam 21 fall into the troughs 20*d* of the stationary cam 20 while the rotatable sliding cam 21 is being rotated with the rotating shaft 10. When the crests 21*b* fall fully into the troughs 20*d*, the seat 5 is opened to a maximum angular position of 110 deg. On the contrary, when the seat 5 is closed, the crests 21*b* of the cam portion 21*d* will move from the troughs 20*d* to the crests 20*c* of the cam portion 20*e* against the elasticity of the elastic means 22, so the seat 5 will not fall abruptly but it will be closed gently. The rubber ring 19 is provided to damp the rotation of the rotating shaft 10.

Owing to the circumference grooves 19*a* on the rubber ring 19, the viscous oil will spread uniformly over the outer surface of the rubber ring 19 and it will not run short.

To adjust the torque of the rotating shaft 10 in the hinge device 3, a screwdriver is introduced from the end of the fixing shaft portion 10*b* of the rotating 10 to turn the adjusting screw 17 clockwise or counterclockwise. In this case, the hinge device 3 may not be removed from the holder 2 for this adjustment. As the adjusting screw 17 is turned, the spring holder 18 moves to the right or left and thus the effective length of the elastic means 22 is increased or decreased so that the elasticity of the elastic means 22 can be adjusted. Thus, the torque of the rotating shaft 10 can be freely adjusted also after the hinge device 3 has been installed. This adjustment is also true for the left hinge device 4.

Figure 14:
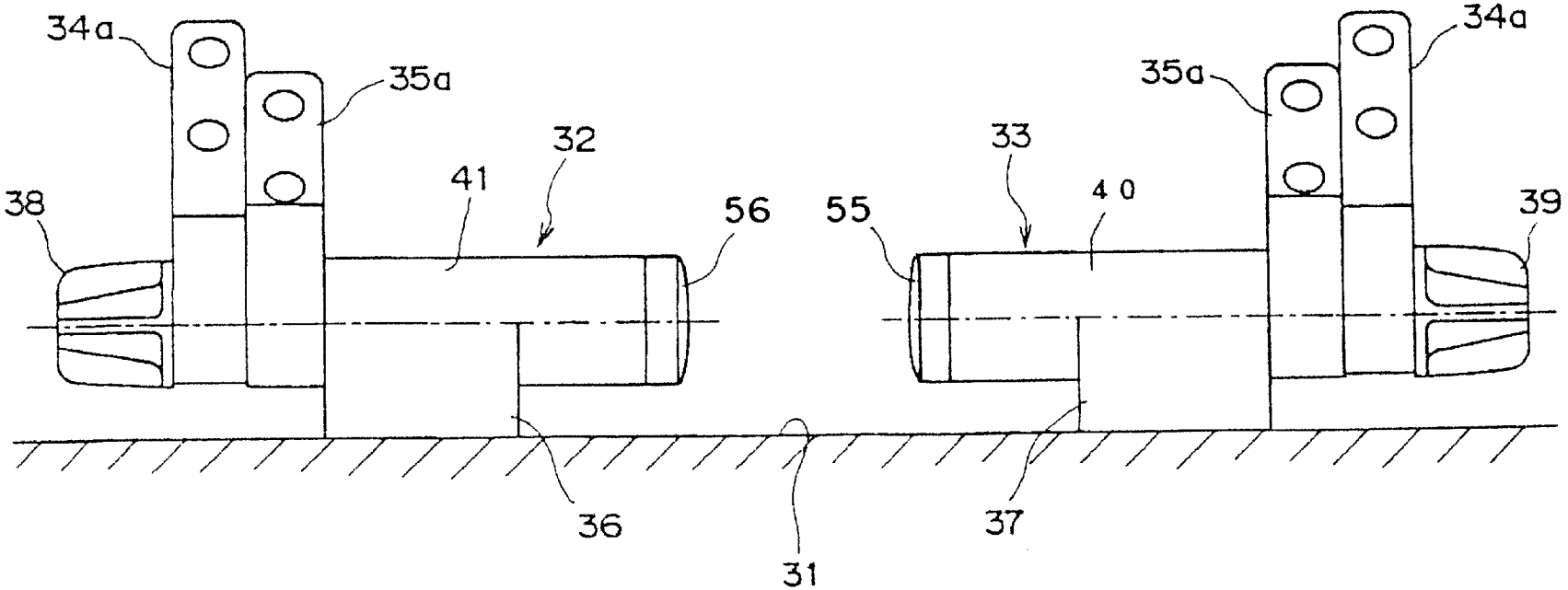
FIG. 14 is a front view of a second embodiment of the hinge device according to the present invention for use with the seat and seat lid of a toilet bowl.
Figure 15:
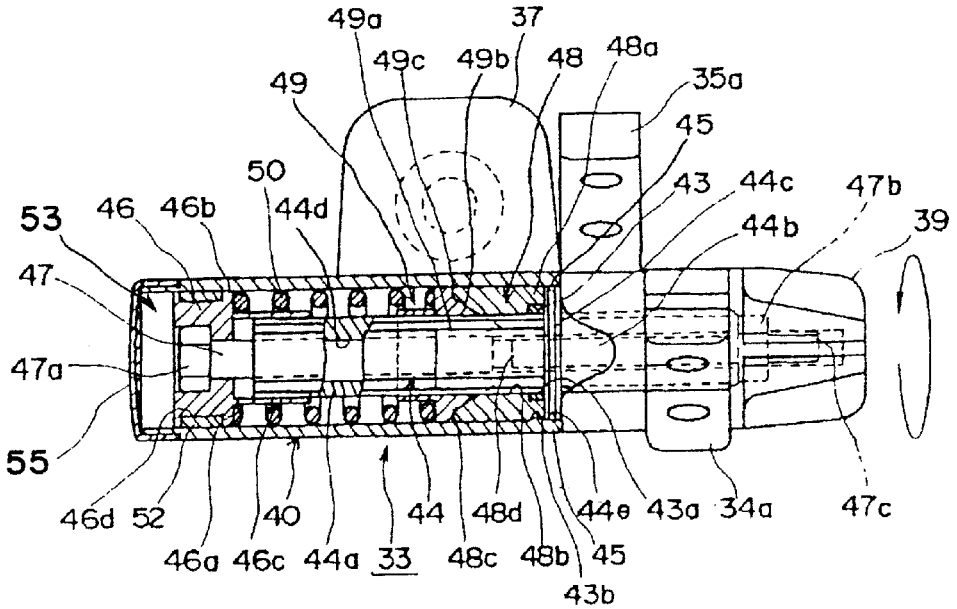
FIG. 15 is a partially sectional plan view of the right half of the hinge device in FIG. 14.
Figure 16:
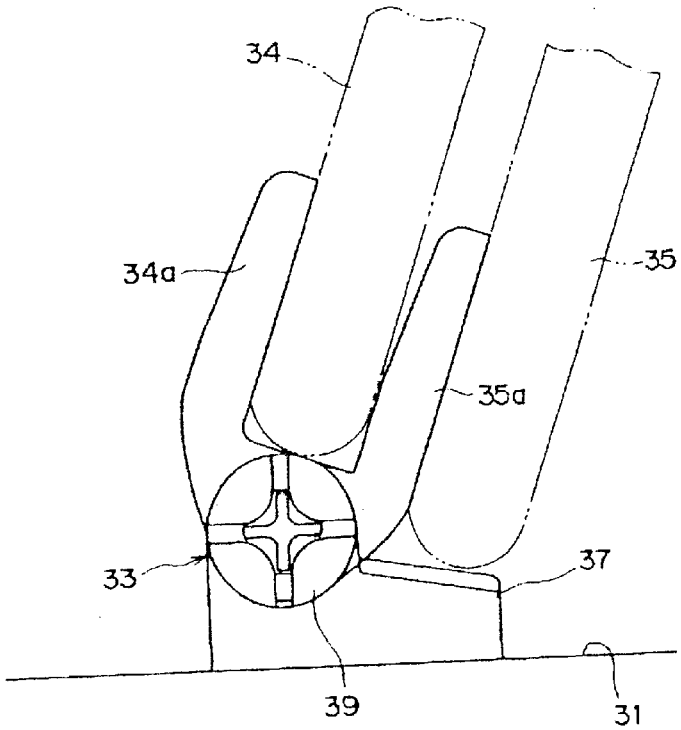
FIG. 16 explains the installation of the right half of the hinge device in FIG. 14.
Figure 17:
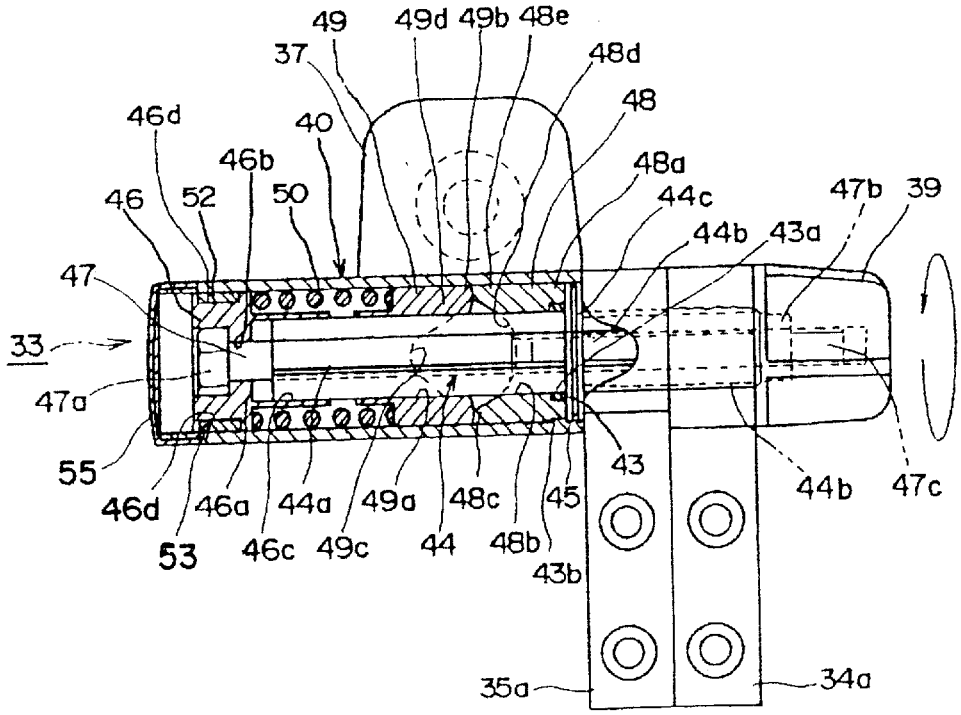
FIG. 17 is a partially sectional plan view of the hinge device in FIG. 15, explaining the function of the hinge device.
Figure 18:
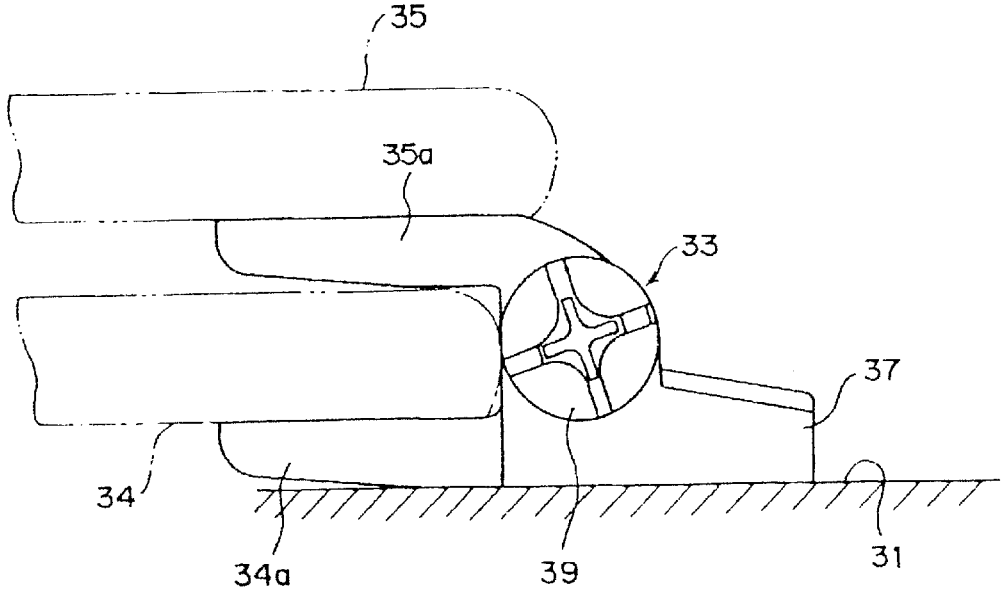
FIG. 18 is a right side elevation of the hinge device in FIG. 17.
Figure 19:
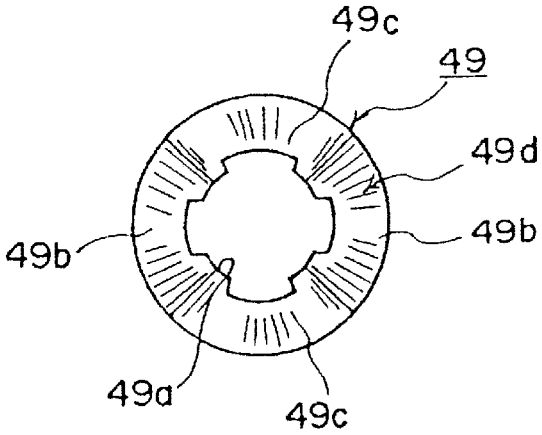
FIG. 19 is a right side elevation of the rotatable sliding cam included in the hinge device in FIG. 15.
Figure 20:
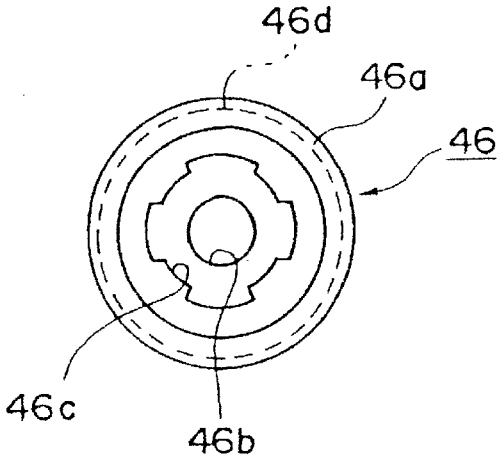
FIG. 20 is a right side elevation of the spring holder included in the hinge device in FIG. 15.
Figure 21:
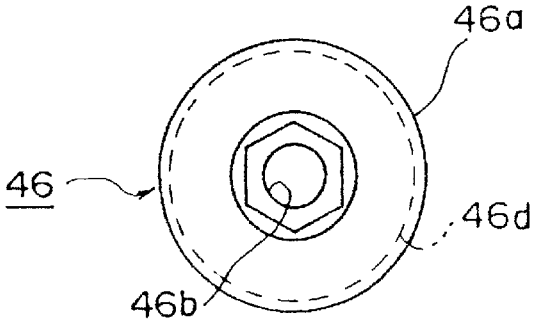
FIG. 21 is a left side elevation of the spring holder in FIG. 19.
Figure 22:
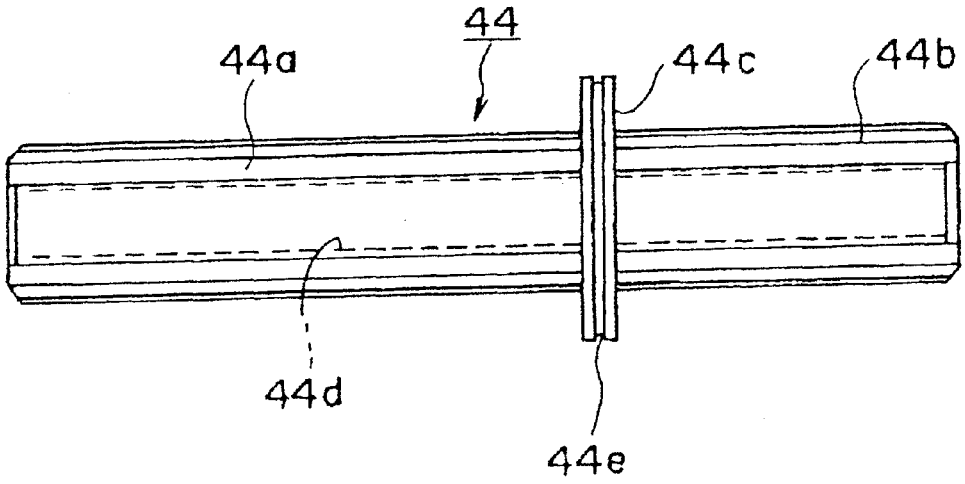
FIG. 22 is a plan view of the rotating shaft shown in FIGS. 14 and 17.
Figure 23:
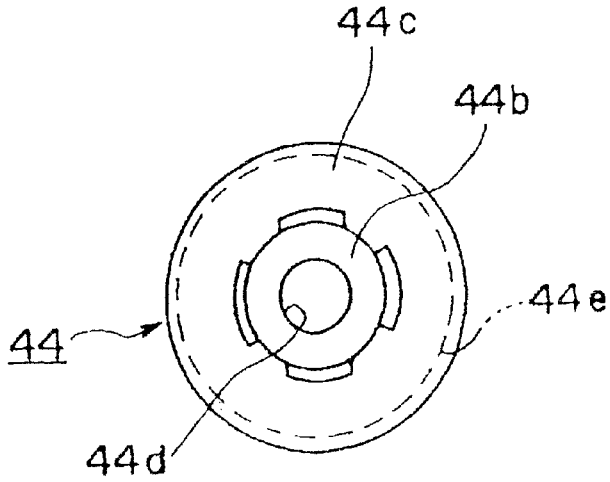
FIG. 23 is a right side elevation of the rotating shaft in FIG. 22.

Further, a second embodiment of the hinge device according to the present invention will be described below with reference to FIGS. 14 to 23. As shown, this embodiment includes a pair of hinge devices 32 and 33. Different from the aforementioned embodiments of the present invention, however, the hinge devices 32 and 33 are not to be installed in a dedicated holder which is to be fixed to the body of a toilet bowl, but they are to be installed independently on the body of a toilet bowl 31. The hinge devices 32 and 33 comprise hinge cases 40 and 41, respectively, and fixtures 36 and 37 projected from the hinge cases 40 and 41, respectively, as shown. As shown in FIG. 14 especially, reference numerals 56, 56 are caps. Of the pair of hinge devices 32 and 33, the left one 32 is for use with a seat of the toilet bowl 31 while the right one 33 is for use with a seat lid. The left and right hinge devices 32 and 33 are of a same basic same internal structure except that they are different in shape of cam member and elasticity of elastic means. Therefore, only the right-side hinge device 33 for the seat will be described below.

The hinge case 40 of the hinge device 33 has a partition wall 43 formed near the right end thereof. The partition wall 43 has formed therein a bearing hole 43*a* through which a rotating shaft 44 is penetrated axially inside the hinge case 40 to be rotatable. The rotating shaft 44 has formed therein a through-hole 44*d* extending longitudinally in the central portion thereof. An adjusting screw 47 is installed axially through the through-hole 44*d*. The adjusting screw 47 is projected at either end thereof from either end of the rotating shaft 44. The screw 47 has a head 47*a* is penetrated through and engaged in a spring holder 46. The rotating shaft 44 consists of a large-diameter portion 44*c* formed at one end thereof and having an outside diameter generally same as the inner diameter of the hinge case 40, and a non-round fixing shaft portion 44*b* projected out of the hinge case 40. The large-diameter portion 44*c* has formed thereon a circumferential groove 44*e* in which an O-ring 45 is fitted. The adjusting screw 47 is projected at the other end thereof out of the fixing shaft portion 44*b* of the rotating shaft 44 and formed to be a knob fixing portion 47*c* on which a but 47*b* is screwed. A knob 39 is secured to the knob fixing portion 47*c*. The spring holder 46 has formed at one end thereof a flange 46*a* which is in contact with the inner wall of the hinge case 40, and at the other end thereof a non-circular engagement hole 46*c* in which a non-round small-diameter portion 44*a* of the rotating shaft 44 is engaged, so that the spring holder 46 is rotatable with the rotating shaft 44 and axially movable inside the hinge case 40. The flange 46*a* of the spring holder 46 has formed thereon a circumferential groove 46*d* in which a rubber ring 52 is fitted. The rubber ring 52 has formed thereon a circumferential groove 52*a* in which a viscous oil (not shown) is applied. The reference 46*b* indicates a circular small hole through which the adjusting screw 47 is penetrated and which concentrically communicates with the non-circular engagement hole 46*c*.

A stationary cam 48 is provided inside the hinge case 40. The stationary cam 48 has a plurality of projections 48*a* formed on one end thereof. The partition wall 43 has also a plurality of engagement holes 43*b* formed therein. The plurality of projections 48*a* is engaged in the plurality of engagement holes 43*b*. The stationary cam 48 has a circular insertion hole 48*b* formed longitudinally in the central portion therein. The rotating shaft 44 has also a non-round small-diameter portion 44*a* which is inserted in the circular insertion hole 48*b*. The stationary cam 48 has a cam portion 48*e* consisting of crests 48*c* and troughs 48*d*. There is provided opposite the cam portion 48*e* of the stationary cam 48 a rotatable sliding cam 49 having a non-circular hole 49*a* formed axially in the central portion thereof. The non-round small-diameter portion 44*a* of the rotating shaft 44 is engaged in the non-circular hole 49*a* of the rotatable sliding cam 49 so that the latter is rotatable with the rotating shaft 44 and slidable axially of the rotating shaft 49. The rotatable sliding cam 49 has provided a cam portion 49*d* consisting of crests 49*b* and troughs 49*c*. An elastic means 50 formed from a compression spring is wound on other than the non-round small-diameter portion 44*a* and flange 46*a* of the spring holder 46 and between the rotatable sliding cam 49 and flange 46*a* of the spring holder 46. The elastic means 50 forces the rotatable sliding cam 49 to slide towards the stationary cam 48.

As shown in FIGS. 15, 17, 18 and 22, the rotating shaft 44 of the left hinge device 33 for the seat is engaged at the non-round fixing shaft portion 44*b* thereof engaged in a non-circular fixing hole (not shown) formed in a fixture 34*a* of a seat lid 34. Thus, as the seat lid 34 is operated, the rotating shaft 44 is rotated correspondingly. The fixing shaft portion 44*b* of the rotating shaft 44 is inserted in a circular fixing hole (not shown) formed in a fixture 35*a* of a seat 35. Thus when the seat 35 is operated, it is rotated about the rotating shaft 44, not rotated with the latter.

On the other hand, the rotating shaft of the left hinge device 32 for the seat 35 has a no-round fixing shaft portion there of engaged in a non-circular fixing hole (not shown) formed in the fixture 35*a* for the seat 35 and born in a circular fixing hole (not shown)formed in the fixture 34*a* for the seat lid 34. Therefore, the rotating shaft of the left hinge device 32 is rotated as the seat 35 is operated but not when the seat lid 34 is operated.

The right hinge device 33 will be described again. When the seat lid 34 is operated, the rotating shaft 44 is rotated correspondingly. When the seat lid 34 is in the closed position, the crests 48*c* of the cam portion 48*e* of the stationary cam 48 are pressed to the crests 49*b* of the cam portion 49*d* of the rotatable sliding cam 49 under the elasticity of the elastic means 50. However, as the seat lid 34 is opened, the rotatable sliding cam 49 is rotated along with the rotating shaft 44 while the crests 49*b* of the cam 49 fall into the troughs 48*d* of the stationary cam 48. When the crests 49*b* full fall into the troughs 48*d*, the seat lid 34 is opened to a maximum angular position of 110 deg.

On the contrary, when the seat lid 34 is closed, the crests 49*b* of the cam portion 49*d* move from the troughs 48*d* of the cam portion 48*e* to the crests 48*c* against the pressure of the elastic means 50. Thus the seat lid 34 will not be closed abruptly but it will be closed gently. The rubber ring 52 of a rotation control means 53 is provided to damp the rotation of the rotating shaft 44, namely, the operation of the seat lid 34.

The circumferential groove 52*a* on the rubber ring 52 spreads the viscous oil uniformly over the outer surface of the rubber ring 52, and thus the viscous oil will not run short.

To adjust the torque of the rotating shaft 44, the knob 39 is turned clockwise or counterclockwise. The spring holder 46 will move rightward or leftward and thus the effective length of the elastic means 50 is increased or decreased, thereby permitting to adjust the elasticity of the elastic means 50. Thus, the pressure of the rotatable sliding cam 49 to the stationary cam 48 can be changed to freely adjust the torque of the operating shaft 44 even after the hinge device 33 is installed to the toilet bowl body 31. By turning the knob 38 of the left hinge device 32 clockwise or counterclockwise, the torque of the rotating shaft can be adjusted in the same manner.

What is claimed is:

1. A hinge device for use to support a seat and seat lid of a toilet bowl which are openably and closably on a body of the toilet bowl, the device comprising;

a cylindrical hinge case having an axis and adapted to be fixed to the body of a toilet bowl;

a rotating shaft having a large-diameter portion and a small-diameter portion and partially inserted into the hinge case such that the rotating shaft is rotatable about the axis of the hinge case;

a stationary cam provided inside the hinge case in a state in which rotation of the stationary cam is restricted, the small-diameter portion of the rotating shaft penetrating a central portion of the stationary cam;

a rotatable sliding cam provided inside the hinge case opposite the stationary cam, the rotatable sliding cam being slidable axially and rotatable along with the small-diameter portion of the rotating shaft, the small-diameter portion of the rotating shaft penetrating the central portion of the rotatable sliding cam;

elastic means having an elasticity and provided inside the hinge case and adapted to press one of the rotatable sliding cam and the stationary cam toward the other of the rotatable sliding cam and the stationary cam; and elasticity adjusting means for adjusting the elasticity of the elastic means, the elasticity adjusting means comprises an adjusting screw penetrating an axially extending through hole of the rotating shaft and adapted to be rotated from a side on which the seat and seat lid are supported by the rotating shaft, a spring holder disposed inside the hinge case, the spring holder being screwed to a portion of the adjusting screw projecting from the rotating shaft and abutting one end of the elastic means, and a knob for rotating the adjusting screw, the knob being attached to a portion of the-adjusting screw projecting from an end of the rotating shaft on which the seat and seat lid are supported.

2. A hinge device for use to support a seat and seat lid of a toilet bowl which are openably and closably on a body of the toilet bowl, the device comprising:

a cylindrical hinge case having an axis and being fixed to the body of a toilet bowl;

a rotating shaft having a large-diameter portion and a small-diameter portion and partially inserted into the hinge case such that the rotating shaft is rotatable about the axis of the hinge case;

a stationary cam provided inside the hinge case in a state in which rotation of the stationary cam is restricted, the small-diameter portion of the rotating shaft penetrating a central portion of the stationary cam;

a rotatable sliding cam provided inside the hinge case opposite the stationary cam, the rotatable sliding cam being slidable axially and rotatable along with the small-diameter portion of the rotating shaft, the small-diameter portion of the rotating shaft penetrating a central portion of the rotatable sliding cam;

elastic means having an elasticity and provided inside the hinge case and adapted to press one of the rotatable sliding cam and the stationary cam toward the other of the rotatable sliding cam and the stationary cam;

elasticity adjusting means for adjusting the elasticity of the elastic means; and rotation control means for controlling rotation of the rotating shaft.

3. A hinge device as set forth in claim 2, wherein the rotation control means is a rotation damper which is connected to the rotating shaft within the hinge case.

4. A hinge device as set forth in claim 2, wherein the rotation control means comprises a rubber ring which is fitted onto an outer circumference of the large-diameter portion of the rotating shaft within the hinge case, and viscous oil applied between the rubber ring and the inner wall of the hinge case.

5. A hinge device for use to support a seat and seat lid of a toilet bowl openably and closably, comprising:

a cylindrical hinge case to be fixed to the body of a toilet bowl;

a rotating shaft having a large-diameter portion and a small-diameter portion and partially inserted into the hinge case such that the rotating shaft is rotatable about an axis of the hinge case;

a stationary cam provided inside the hinge case in a state in which rotation of the stationary cam is restricted, the small-diameter portion of the rotating shaft penetrating a central portion of the stationary cam;

a rotatable sliding cam provided inside the hinge case opposite the stationary cam to be slidable axially and rotatable along with the small-diameter portion of the rotating shaft, the small-diameter portion of the rotating shaft penetrating a central portion of the rotatable sliding cam;

elastic means provided inside the hinge case and adapted to press one of the rotatable sliding cam and the stationary cam toward the other of the rotatable sliding cam and the stationary cam;

elasticity adjusting means for adjusting elasticity of the elastic means;

rotation control means for controlling rotation of the rotating shaft;

the elasticity adjusting means comprising an adjusting screw penetrating an axially extending through hole of the rotating shaft and adapted to be rotated from a side on which the seat and seat lid are supported by the rotating shaft, a spring holder disposed inside the hinge, the spring holder being screwed to a portion of the adjusting screw projecting from the rotating shaft and abutting one end of the elastic means, and a knob for rotating the adjusting screw, the knob being attached to a portion of the adjusting screw projecting from an end of the rotating shaft on which the seat and seat lid are supported; and the rotation control means comprising a rubber ring which is fitted onto an outer circumference of the spring holder within the hinge case, and viscous oil applied between the rubber ring and the inner wall of the hinge case.

* * * * *